United States Patent [19]

Quack

[11] 4,332,136

[45] Jun. 1, 1982

[54] REFRIGERATING APPARATUS

[75] Inventor: Hans Quack, Pfaffikon, Switzerland

[73] Assignee: Sulzer Brothers Ltd., Winterthur, Switzerland

[21] Appl. No.: 256,403

[22] Filed: Apr. 22, 1981

[30] Foreign Application Priority Data

Apr. 29, 1980 [CH] Switzerland ..... 3296/80

[51] Int. Cl.[3] ..... F17C 13/00

[52] U.S. Cl. ..... 62/54; 62/514 R; 220/85 VR

[58] Field of Search ..... 62/54, 514 R, 203, 208; 220/85 VR, 85 VS; 55/88, 89

[56] References Cited

U.S. PATENT DOCUMENTS

| | | | |
|---|---|---|---|
| 2,928,254 | 3/1960 | Rae | 62/54 |
| 2,944,405 | 7/1960 | Basore et al. | 62/54 |
| 3,303,660 | 2/1967 | Berg | 62/54 |
| 3,722,581 | 3/1973 | Sauer | 62/514 R |
| 3,972,201 | 8/1976 | Datis | 62/54 |

*Primary Examiner*—Ronald C. Capossela

*Attorney, Agent, or Firm*—Kenyon & Kenyon

[57] ABSTRACT

The refrigerating apparatus for a load in a coolant bath has a buffer tank which is maintained at a low pressure via a vacuum pump. The buffer tank communicates via a valve with a vapor chamber above the coolant bath. Upon an increase in heat evolution from the load above the rating of the compressor, the pressure in the vapor chamber causes the valve to open and excess vapor to escape into the buffer tank. The pressure in the vapor chamber thus remains constant while the temperature of the load does not increase.

10 Claims, 2 Drawing Figures

REFRIGERATING APPARATUS

Figure 1:
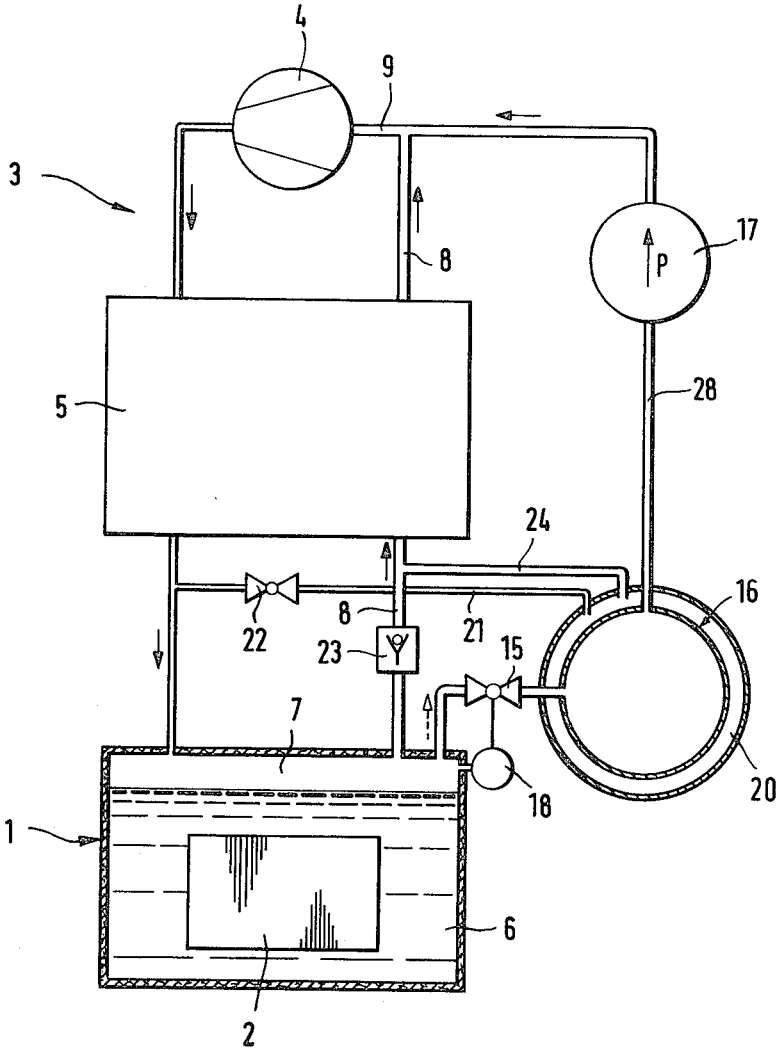

This invention relates to a refrigerating apparatus. More particularly, this invention relates to a refrigerating apparatus having a refrigerant bath and means for maintaining a constant pressure in the bath.

Heretofore, various types of refrigerating apparatus have been known for maintaining a load in a refrigerated state. Generally, such an apparatus includes a refrigerant bath for the refrigeration load and a refrigerating circuit for cycling a refrigerant through the bath. Further, the refrigerating circuits usually have a compressor for compressing vaporized refrigerant received from a vapor chamber above the refrigerant bath and one or more cooling stages for at least partial liquefaction of the compressed refrigerant prior to the return of the refrigerant to the load.

As is known, the temperature of a refrigeration load is closely related to the pressure of the vaporized refrigerant in the vapor chamber above the refrigerant bath as can be determined from the vapor pressure curve of the refrigerant. It is also often very important that the temperature of the refrigeration load should not exceed a critical level, for example, as in the case of a super-conductive magnet which becomes normally conductive at an excess temperature as well as in the case of a cryo pump whose frozen gas molecules desorb if the temperature becomes excessive such that a high vacuum is destroyed.

In many cases, the heat evolved by a refrigeration load is not evolved uniformly but in peaks which briefly exceed the refrigeration output of the refrigerating apparatus. However, it is important that the refrigeration load remain at a prescribed working temperature even, and particularly, during such peaks, i.e., the pressure in the vapor chamber of the refrigerant bath must remain constant as much as possible so as to continue to correspond to the prescribed working temperature of the load.

In view of the above, it has been known for the vapor chamber of a refrigerant bath of a refrigeration apparatus to be of substantial volume in order to obviate an abrupt increase in pressure. However, the disadvantage of this feature is the expense required to construct such a chamber. Another disadvantage is the fact that such a construction merely attenuates the temperature rise on load peaks of the refrigerating apparatus.

Accordingly, it is an object of the invention to prevent pressure increases from occurring in a vapor chamber of a refrigerating apparatus in response to load peaks.

It is another object of the invention to prevent the temperature of a refrigeration load from increasing due to changes in pressure of a refrigerant bath.

It is another object of the invention to provide a refrigerating apparatus which has the ability of producing a brief pressure decrease in a vapor chamber during loading peaks.

Briefly, the invention provides a refrigerating apparatus comprised of a housing for a refrigerant or coolant bath which has a chamber for receiving vaporized refrigerant from the bath, a refrigerating circuit and a buffer tank connected to the chamber for receiving vaporized refrigerant therefrom. The refrigerating circuit has a compressor for compressing a flow of vaporized refrigerant from the vapor chamber for recycling to the housing and at least one cooling stage for at least partial liquefaction of the compressed refrigerant prior to delivery to the housing.

In addition, a means is provided for controlling a flow of vaporized refrigerant from the vapor chamber to the buffer tank. For example, this means includes a valve in a line between the vapor chamber and the buffer tank and a control means for controlling the valve in dependence upon the pressure in the vapor chamber. A further means communicates the buffer tank with the compressor for delivering vaporized refrigerant in the tank to the compressor for recycling to the housing. This means may be in the form of a vacuum pump for pumping refrigerant from the buffer tank to the compressor.

A means may also be provided for cooling the buffer tank to a temperature below ambient temperature. Such a means may be connected to the refrigerating circuit in order to receive a flow of liquified refrigerant for cooling purposes.

In another embodiment, the buffer tank may be filled with an adsorbent in order to increase the capacity of the buffer tank.

Figure 2:
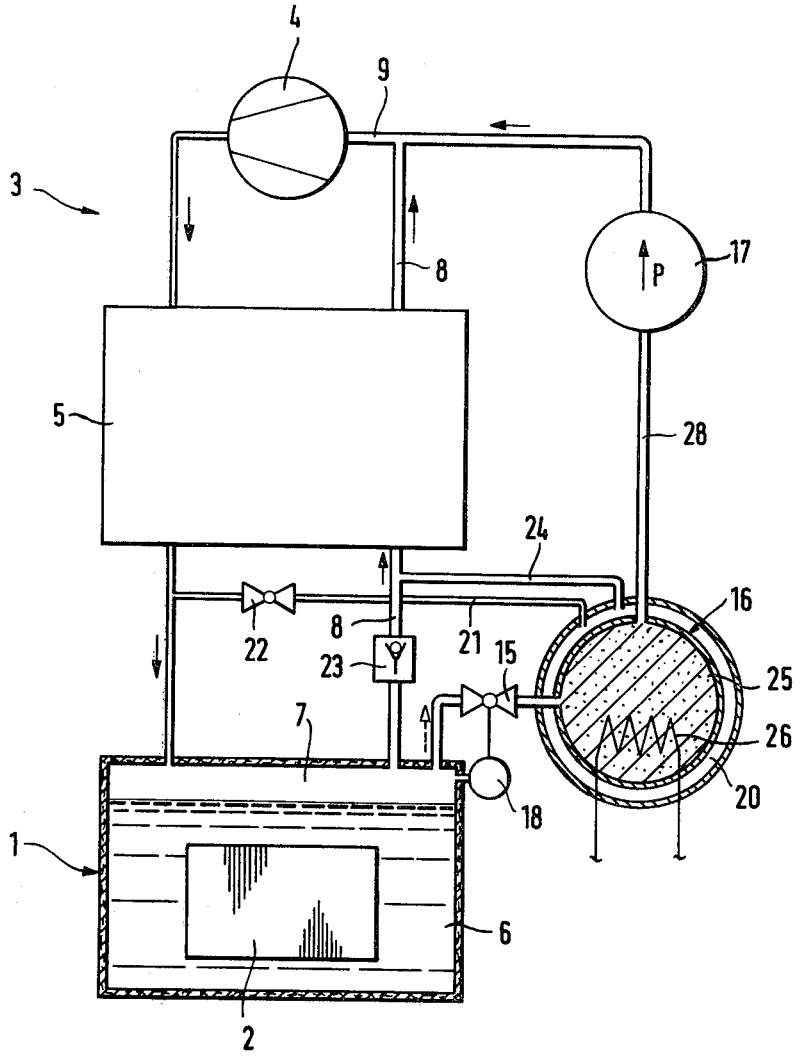

These and other objects and advantages of the invention will become more apparent from the following detailed description taken in conjunction with the accompanying drawings in which:

FIG. 1 illustrates a schematic view of a refrigerating apparatus constructed in accordance with the invention; and FIG. 2 illustrates a modified embodiment of a refrigerating apparatus according to the invention using an adsorbant in the buffer tank.

Referring to FIG. 1, the refrigerating apparatus includes a housing 1 within which a refrigeration load 2 is disposed. In addition, the housing 1 contains a refrigerant or coolant bath 6 which is supplied to the housing 1 by a refrigerating circuit 3 and a vapor chamber 7 above the bath 6 in which vaporized refrigerant may collect.

The refrigerating circuit 3 has a compressor 4 and at least one cooling stage 5. The compressor 4 has an intake 9 which communicates with the vapor chamber 7 via a line 8 and the cooling stage 5 so as to receive and compress a flow of vaporized refrigerant from the chamber 7 for recycling to the housing 1. The compressor 4 also has an outlet connected to the chamber 7 via the cooling stage 5 for delivering a flow of compressed refrigerant to the chamber 1. The cooling stage 5 serves to at least partially liquefy the refrigerant delivered from the compressor 4 prior to delivery to the housing 1.

A buffer tank 16 is disposed outside the housing 1 and is suitably connected via a line to the housing 1 to receive vaporized refrigerant from the vapor chamber 7. In addition, a means is provided for controlling the flow of the vaporized refrigerant from the chamber 7 to the tank 16. This means includes a valve 15 in the connection line between the chamber 7 and the tank 16 and a means 18 for controlling the valve 15 in dependence upon the pressure in the vapor chamber 7.

A means is also provided to communicate the tank 16 with the compressor 4 in order to deliver vaporized refrigerant from the tank 16 to the compressor 4 for recycling to the housing 1. This means includes a pipe 28 and a vacuum pump 17 in the pipe 28 for pumping the refrigerant from the tank 16 to the intake 9 of the compressor 4.

A check valve 23 is also provided in the line 8 to prevent a backflow of vapor or refrigerant into the housing 1. In addition, a means is provided for cooling the buffer tank 16 to a temperature below ambient temperature. As indicated, this means includes a jacket 20 about the tank 16 for forming a chamber, an inlet line 21 connected between the jacket 20 and the refrigerating circuit and a return line 24 between the jacket 20 and the line 8 of the refrigerating circuit. In this way, liquified refrigerant can be supplied to the jacket 20 for cooling the tank 16. A suitable valve 22 is also provided in the line 21 for controlling the flow of refrigerant to the jacket 20.

In normal operation, the valve 15 is in a closed state while the vacuum pump 17 operates to insure a very low pressure in the buffer tank 16.

Should a loading peak occur, that is, should there be an increased evolution of heat from the load 2 without a corresponding change in the operation of the compressor 4 to maintain the pressure in the vapor chamber 1, the pressure will increase in the vapor chamber 7. This increased pressure is detected by the control means 18 and when a predetermined value occurs, the control means 18 causes the valve 15 to open. Thus, an additional flow of vapor occurs from the vapor chamber 7 through the valve 15 into the buffer tank 16 since the pressure in the buffer tank 16 is very low. The pressure in the vapor chamber 7 and, therefore, the temperature of the refrigerant 6 in the housing 1 remain constant. As a result, the temperature of the load 2 does not rise. Once the loading peak has passed, that is, once the compressor 4 can deal with the vapor presented thereto on its own, the control means 18 recloses the valve 15. At this time, the pump continues to pump the vapor out of the tank 16 and reduces the pressure therein to the previous low level. The vapor thus removed is taken in by the compressor 4 via the line 28 and intake 9.

It is to be noted that the usual operation of the refrigerating circuit is such that the compressor 4 serves to compress the vaporized refrigerant while the cooling stage 5 serves to at least partially liquify the compressed refrigerant. The liquified refrigerant is then delivered into the bath 6 within the housing 1 for cooling the load 2.

It is further noted that the control means 18 can be constructed so as to open the valve 15 abruptly and fully in response to an abrupt and substantial load peak of the refrigerant bath 6. In this way, a large volume of vapor can flow rapidly to the buffer tank 16 while the pressure in the vapor chamber 7 drops so rapidly that the temperature of the refrigerant bath 6 drops. This is desirbale for many uses of the refrigerating apparatus. In this case, the check valve 23 in the line to the cooling stage 5 prevents the tank 16 from intaking refrigerant from the circuit 3.

The instruction or signal to open the valve 15 can, of course, emanate from other sources than the control means 18. For instance, signals may be associated with the apparatus to indicate that a peak in the evolution of heat from the load 2 is imminent.

One particular advantage of the refrigerating apparatus is that in the event of a failure of the refrigerating circuit 3, the buffer tank 16 continues to cool the load 2 for sometime by absorption of vapor from the vapor chamber 7 until either the apparatus restarts or the load 2 has been definitely shut off.

It is to be noted that the volume of the buffer tank 16 can be reduced if the temperature in the tank 16 is below the ambient temperature. Further, instead of utilizing the cooling jacket 20, the buffer tank 16 may be in heat-conductive contact with the refrigerant bath 6 so as to have the temperature of the tank 16 reduced to the temperature of the refrigerant bath 6.

Referring to FIG. 2 wherein like reference characters indicate like parts as above, the buffer tank 16 may be wholly or partly filled with an adsorbent 25 such as activated charcoal in order to enable the quantity of the refrigerant vapor which is storable in the tank 16 of given dimensions to be increased considerably. The emptying of the buffer tank 16 and the regeneration of the adsorbent 25 are effected via the vacuum pump 17 with the valve 15 closed. Regeneration may also be boosted by means of a heating winding 26 which can be briefly energized.

The invention thus provides a refrigerating apparatus which is able to maintain a refrigeration load at a constant cooled temperature in a relatively simple manner.

What is claimed is:

1. A refrigerating apparatus comprising a housing for a refrigerant bath, said housing having a chamber for receiving vaporized refrigerant;

a refrigerating circuit including a compressor having an intake connected to said chamber for receiving and compressing a flow of vaporized refrigerant from said chamber and an outlet connected to at least one cooling stage for at least partial liquefaction of the compressed refrigerant delivered from said compressor and an outlet leading from said cooling stage for delivery of said at least partially liquefied refrigerant to said chamber;

a buffer tank connected to said chamber for receiving vaporized refrigerant therefrom;

a valve between said housing chamber and said buffer tank for controlling a flow of vaporized refrigerant from said chamber to said tank; and a vacuum pump communicating said buffer tank with said compressor intake to deliver vaporized refrigerant from said tank to said compressor.

2. A refrigerating apparatus as set forth in claim 1 which further comprises control means for controlling said valve in dependence upon the pressure in said chamber.

3. A refrigerating apparatus as set forth in claim 1 which further comprises an adsorbent filling said buffer tank.

4. A refrigerating apparatus as set forth in claim 1 which further comprises means for cooling said buffer tank to a temperature below ambient temperature.

5. A refrigerating apparatus as set forth in claim 4 wherein said means for cooling is connected to said refrigerating circuit to receive a flow of liquified refrigerant.

6. A refrigerating apparatus comprising a housing for a refrigerant bath, said housing having a chamber for receiving vaporized refrigerant;

a refrigerating circuit having a compressor for compressing a flow of vaporized refrigerant from said chamber for re-cycling to said housing and at least one cooling stage for at least partial liquefaction of the compressed refrigerant prior to delivery to said housing;

a buffer tank connected to said chamber to receive vaporized refrigerant therefrom;

first means for controlling a flow of vaporized refrigerant from said chamber to said tank; and second means communicating said tank with said compressor for delivering vaporized refrigerant in said tank to said compressor for re-cycling to said housing.

7. A refrigerating apparatus as set forth in claim 6 wherein said first means includes a valve and a control means for controlling said valve in dependence upon the pressure in said chamber.

8. A refrigerating apparatus as set forth in claim 7 wherein said second means is a vacuum pump.

9. A refrigerating apparatus as set forth in claim 6 wherein said second means is a vacuum pump.

10. A refrigerating apparatus as set forth in claim 6 which further comprises means for cooling said buffer tank to a temperature below ambient temperature.

* * * * *